United States Patent [19]

Skogward

[11] Patent Number: 4,748,917

[45] Date of Patent: Jun. 7, 1988

[54] ARRANGEMENT IN A SEWING MACHINE

[75] Inventor: Kenneth O. E. Skogward, Huskvarna, Sweden

[73] Assignee: Husquarna Aktiebolag, Sweden

[21] Appl. No.: 914,782

[22] Filed: Oct. 3, 1986

[30] Foreign Application Priority Data

Oct. 23, 1985 [SE] Sweden ..... 8504994

[51] Int. Cl.[4] ..... D05B 69/02

[52] U.S. Cl. ..... 112/220; 112/221; 112/443

[58] Field of Search ..... 112/220, 221, 443, 455, 112/456

[56] References Cited

U.S. PATENT DOCUMENTS

| | | | |
|---|---|---|---|
| 2,559,438 | 7/1951 | Jocsak et al. | 112/443 |
| 2,760,457 | 8/1956 | Rabezzank | 112/221 |
| 2,793,600 | 5/1957 | Francois | 112/220 |
| 2,828,708 | 4/1958 | Ayres | 112/220 |
| 4,503,793 | 3/1985 | Odermann | 112/221 X |
| 4,512,273 | 4/1985 | Skogward | 112/315 |
| 4,641,593 | 2/1987 | Echavarrio | 112/443 |

FOREIGN PATENT DOCUMENTS

| | | | |
|---|---|---|---|
| 109946 | 5/1984 | European Pat. Off. | 112/221 |
| 951607 | 10/1956 | Fed. Rep. of Germany | 112/220 |
| 83/01795 | 5/1983 | PCT Int'l Appl. | 112/315 |
| 154154 | 4/1956 | Sweden | 112/220 |
| 1089188 | 4/1984 | U.S.S.R. | 112/443 |

*Primary Examiner*—Wm. Carter Reynolds
*Attorney, Agent, or Firm*—Alfred E. Miller

[57] ABSTRACT

A sewing machine in which the bed shaft and the arm shaft have been replaced by a synchronous belt and the plane of rotation of the synchronous belt is perpendicular to the cloth feeding direction. All function units which drive or are driven by the synchronous belt and the belt itself are mounted on the same side of the sewing machine body. A number of backing rollers guide the synchronous belt in the plane of rotation. These backing rollers are on shafts which are either stationary or driving. The shafts are supported by the sewing machine body in rotation or stationary manners. The backing rollers can be smooth or toothed wheels which drive or are driven by the synchronous belt. Some toothed wheels can drive several function units of the sewing machine. By changing the diameter of the toothed wheels in relation to each other the time relation between the several function units of the sewing machine can be controlled. The driving motor can be connected to one of these toothed wheels directly, driving the several function units via the synchronous belt without intervening primary transmission.

5 Claims, 1 Drawing Sheet

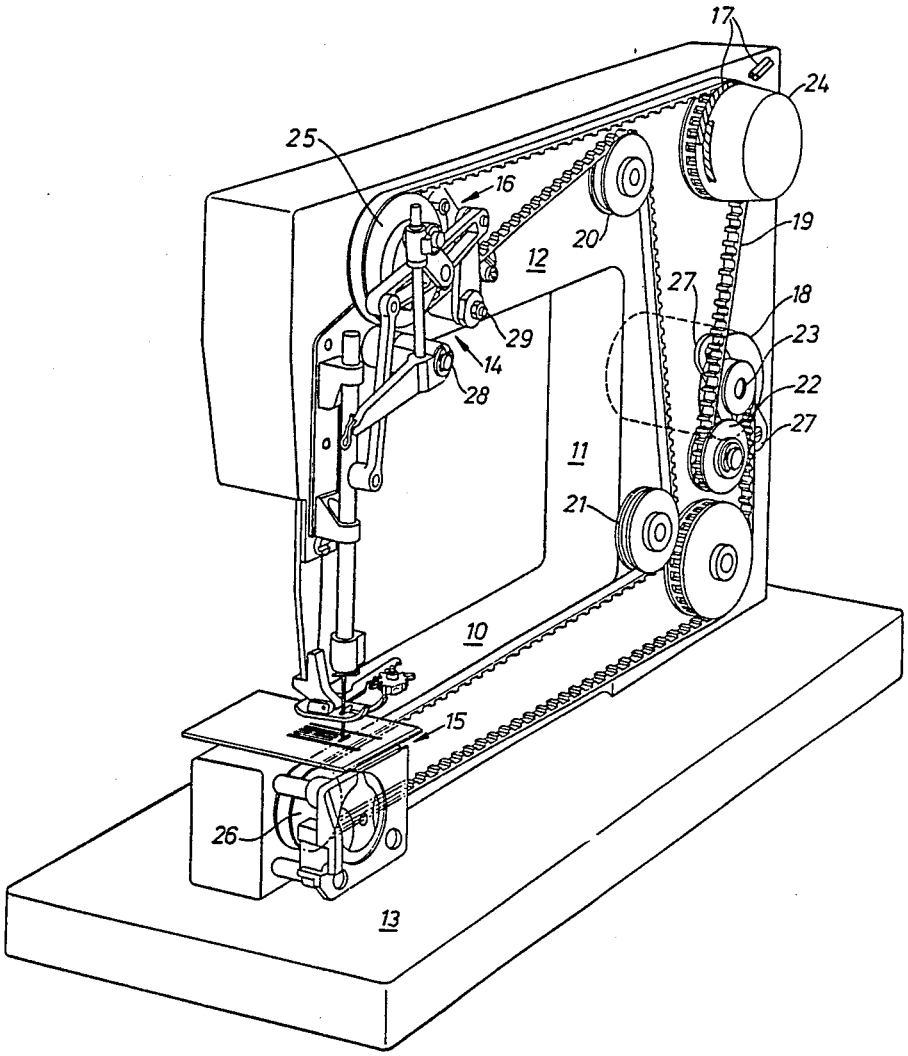
17
24
25
16
20
19
12
27
18
29
23
14
22
28
27
11
21
10
15
26
13

ARRANGEMENT IN A SEWING MACHINE

The present invention relates to an arrangement in a sewing machine in which several function units are driven by an endless synchronous belt from a driving motor.

In the prior art in this field it is known to produce a sewing machine with a body comprising a post, an upper arm and a lower arm in which shafts, driving members and control means are secured and/or journalled, and a driving belt connects a motor to these members. A machine designed according to this principle is described in U.S. Pat. No. 2,793,600. However, the construction shown therein has a drawback in that the driving belt and the driving device of a thread take-up lever etc. are disposed on the opposite side of the machine body in relation to the other function units.

This invention provides a solution of the problem by replacing units which are difficult to mount, such as shafts etc. in the machine by a synchronous belt having a plane of rotation perpendicular to the feeding direction of the machine. The solution includes the favourable fact that all function units and the belt itself are mounted on one side of the machine body which is a very great advantage for assembling the machine. Another advantage is that the driving motor is connected directly to the belt via a toothed wheel without an intervening primary transmission.

An embodiment of a sewing machine according to the invention will now be described with reference to the accompanying drawing which shows in a perspective view the machine body with function units and a driving belt in accordance with the invention.

A sewing machine needs a rigid body in order that relative movements between the function units within the machine shall not be possible. The body shown in the FIGURE is a design including a lower arm 10, a post 11 and an upper arm 12, the post being fixed on a bottom plate 13. The function units, such as the sewing head 14, the loop-taker and feeding device 15, the zig-zag mechanism 16, the hand wheel unit etc. are disposed on the front side of the body. Previous designs of a sewing head and a loop-taker and feeding unit have been described in European patent application No. 109,946 and PCT application No. 83/01795, and both these function units can advantageously be used in the sewing machine described herein. However, a requirement herefore is that the driving wheel be positioned in the respective units so that driving by a belt on one long side of the body, as shown, is possible. The position of the wheels on driving shafts outside the bearings is here a modification of the previously shown embodiments of the respective unit. Both the said units use a stepper motor for carrying out zig-żag movements and feeding movements, respectively, which requires a control of the seam data of the machine by an electronic unit which in the present case is assumed to be positioned in a cover including i.a. a panel with guiding and indication means.

A code disc 17 or the like with a sensor, e.g. in the hand wheel unit of the machine, supplies signals to the electronic unit, thus indicating in which phase of the stitch forming cycle the machine is for the moment. Such signalling devices are generally known and need no particular description.

The driving system of the machine is comprised of an electric motor 18 and an endless toothed belt 19 (alternatively a chain) which is tensioned between toothed wheels and backing rollers 20, 21, 22. The motor has a pinion 23 driving the system directly. The hand wheel 24 of the machine is journalled on a fixed or journalled shaft in the body and somewhat unconventionally positioned on the front side of the machine. By using toothed wheels 25, 26 with different diameters for driving the sewing head and the loop-taker, respectively, it is possible to guide the time relation between the functions of these units in the stitch forming. The r.p.m. of the loop-taker shall usually be double the r.p.m. of the sewing head, so the wheel 26 has half the diameter of the diameter of the wheel 25. By assembling the loop-taker and the cloth feeder in one unit, it is only necessary to adjust the time relation for the unit to the sewing head once, e.g. for the loop-taker, whereby the function of the feeder will also be correct.

As shown in the FIGURE it is possible to assemble all components in the driving system on the front side of the machine. The backing rollers are assembled on fixed or journalled shafts in the body, and the motor 18 is inserted into an aperture in the body and secured by lugs 27 on the front side of the body. In a similar way the details of the sewing head are supported on shafts 28, 29 which are disposed on the belt side of the machine.

Due to the use of the belt transmission great possibilities are provided in enabling changing the appearance of the machine without changing the associated function units. The only necessary thing to do when the size of the machine is to be changed, is to use a shorter or longer belt on a bigger or smaller body. The conventional design of a sewing machine having long shafts as transmission members does usually not give such possibilities of model variations as thus the hereinbefore described design with belt transmission does.

I claim:

1. In a sewing machine arrangement having a body comprising a post, an upper arm and a lower arm, said body having first and second opposite longitudinally extending sides, said sewing machine arrangement further having a driving motor, a synchronous belt or chain coupled to said driving motor, and a plurality of function units including a sewing head, a loop-taker and a feeding device, the improvement wherein the function units are mounted on said first side of said body and have belt or chain drive wheels positioned on said first side of said body for the driving of the respective unit, the motor has a pinion on said first side of the body, and the belt or chain extends on said first side of said body and is tensioned between said wheels and tension rollers assembled on said first side, said belt or chain extending in a plane substantially perpendicular to the cloth feeding direction of the machine, whereby said function units and belt or chain drive are all accessible for assembly, disassembly and service from said first side of said body.

2. Arrangement according to claim 1, wherein a hand wheel with a driving wheel is journalled on a shaft projecting on said first side of the body.

3. Arrangement according to claim 1, wherein all rollers and wheels supporting the belt have shafts directed perpendicularly to the plane of rotation of the belt.

4. Arrangement according to claim 1, wherein one of the wheels driven by the synchronous belt is provided with a decoder for detecting an angle position in the sewing machine during a sewing operation.

5. Arrangement according to claim 1, wherein said pinion engages the belt.

* * * * *